US009951636B2

(12) United States Patent
Mareix et al.

(10) Patent No.: US 9,951,636 B2
(45) Date of Patent: Apr. 24, 2018

(54) DOUBLE TUBE CONNECTING DEVICE

(71) Applicant: SNECMA, Paris (FR)

(72) Inventors: Jean Pierre Mareix, Moissy-Cramayel (FR); Emmanuel Berche, Moissy-Cramayel (FR); Jean Luc Bacha, Moissy-Cramayel (FR); Tangi Brusq, Moissy-Cramayel (FR)

(73) Assignee: SNECMA, Paris (FR)

( * ) Notice: Subject to any disclaimer, the term of this patent is extended or adjusted under 35 U.S.C. 154(b) by 289 days.

(21) Appl. No.: 14/655,708

(22) PCT Filed: Dec. 20, 2013

(86) PCT No.: PCT/FR2013/053224
§ 371 (c)(1),
(2) Date: Jun. 25, 2015

(87) PCT Pub. No.: WO2014/102494
PCT Pub. Date: Jul. 3, 2014

(65) Prior Publication Data

US 2015/0345317 A1 Dec. 3, 2015

(30) Foreign Application Priority Data

Dec. 27, 2012 (FR) ..... 12 62880

(51) Int. Cl.
*F01D 9/06* (2006.01)
*F01D 11/00* (2006.01)

(52) U.S. Cl.
CPC ..... *F01D 9/065* (2013.01); *F01D 9/06* (2013.01); *F01D 11/005* (2013.01)

(58) Field of Classification Search
CPC ..... F01D 9/065; F01D 9/06; F01D 11/005; F16L 17/04; F16L 59/021
USPC ..... 415/135
See application file for complete search history.

(56) References Cited

U.S. PATENT DOCUMENTS 7,008,185 B2 * 3/2006 Peterman ..... F01D 5/189 415/115

FOREIGN PATENT DOCUMENTS

| | | |
|---|---|---|
| EP | 1130305 | 9/2001 |
| EP | 1538306 | 6/2005 |
| GB | 553157 | 5/1943 |
| WO | WO-0070192 | 11/2000 |

OTHER PUBLICATIONS

International search report, dated Apr. 11, 2014, Application No. PCT/FR2013/053224.
French Search Report, dated Oct. 10, 2013, French Application No. 1262880.

* cited by examiner

*Primary Examiner* — Logan Kraft
*Assistant Examiner* — Peter T Hrubiec
(74) *Attorney, Agent, or Firm* — Womble Bond Dickinson (US) LLP

(57) ABSTRACT

The invention relates to a device for connection between two enclosures of a turbomachine, for enabling the circulation of a coolant between said enclosures, via said connection device, said connection device comprising an outer tube (2) having an opening (3) extending along the entire length of said outer tube (2), and also comprising an inner tube (6) extending inside the outer tube (2).

9 Claims, 7 Drawing Sheets

DOUBLE TUBE CONNECTING DEVICE

The present invention relates to a device for connecting two enclosures of a turbomachine to allow the establishment through said connecting device of circulation of a cooling fluid between said enclosures.

A turbomachine's turbine generally has an air circulation circuit between a supply enclosure at the low-pressure stator and the rotor of the low-pressure turbine. This air circulation circuit is established through connecting devices connecting two enclosures of a turbomachine to allow the establishment through said connecting device of cooling air circulation between said enclosures.

FIG. 1 is a section view illustrating the connecting devices 20, 21 in a low-pressure portion of a turbine of a turbomachine. FIG. 2 is an enlargement of FIG. 1 showing a first connecting device arranged between a first enclosure at the high-pressure compressor and a second enclosure consisting of a turbine nozzle vane. FIG. 3 is a section view showing a connecting device positioned between a first enclosure consisting of a turbine nozzle vane and a second enclosure consisting of the inside of the low-pressure rotor.

With reference to FIGS. 1, 2, and 3, the air in this circuit is drawn upstream from a compressor of the turbomachine and arrives at a first enclosure 22, constituting a supply enclosure. It then passes through the outer wall 25 of the turbine nozzle 23 by means of a first tubular connecting device 20 through which is established the air circulation circuit.

The air circulation circuit typically passes through circulation channels provided in a vane 24 of the turbine nozzle 23. Part of the air is released into the gas circulation stream by orifices (not shown) formed near the trailing edges of the vane 24 of the turbine nozzle. Another part of the air passes through the circulation channel provided in the vane 24 of the turbine nozzle 23 to reach a second tubular connecting device 21 which allows the cooling air circuit to pass through the internal wall 26 of the turbine nozzle and the casing 27 of the stator to arrive at the flanges 28 of the low-pressure rotor so as to cool them.

This circulation circuit thus has two important functions, consisting of carrying the cooling air

- from the high-pressure compressor to the vanes 24 of the turbine nozzle 23, and
- from the turbine nozzle 23 to the flanges 28 of the low-pressure rotor.

The establishment of this air circulation circuit is made possible by means of two hollow tubular connecting devices which allow circulation of the air between two enclosures such as the supply enclosure and a channel provided in the vane 24 of the turbine nozzle 23.

These connecting devices also make it possible to absorb the relative displacements between the elements defining these enclosures, particularly in the case of vibration or thermal expansion.

Typically, these connecting devices take the form of connecting tubes with a so-called "dog bone" shape, having external sections enlarged at their ends by which the connecting tube cooperates with the wall elements of the enclosures which it connects, or with intermediate bushings connecting it to said elements. Patent application EP 1 538 306 has such devices.

The tubular connecting devices must in addition ensure a good seal in the connection that they constitute. Ensuring a good seat requires:

- tight tolerances on the connecting device and the parts in contact therewith, and

- implementing a coating at the contacts between the connecting device and the elements that it connects, for example the casing or the turbine nozzle sector.

Thus, to obtain a good sealing, it is also necessary to provide for good clamping at the contacts between the connecting device and the elements that it connects.

However, wear is noted, particularly in rotation, of these tubular connecting devices, due to the different constraints to which they are subjected during operation of the turbomachine, and even breakage of these devices. A structure that is altered, cracked or broken no longer allows these devices to ensure sealing of the air circulation circuit.

It is also possible to observe disengagements of these tubular connecting devices, for example following wear or upon breakage of a portion of the tubular connecting device, which then cannot ensure either the sealing of the air circulation circuit, but also the establishment of this air circulation circuit.

PRESENTATION OF THE INVENTION

One general aim of the invention is to correct all or part of the shortcomings of the connecting devices of the prior art.

It proposes in particular a connecting device between two enclosures of a turbomachine to allow the establishment, through said connecting device, of a cooling fluid circulation between said enclosures, said connecting device including an outer tube having an opening extending over the entire length of said outer tube, said outer tube being shaped to cooperate with the wall elements of the enclosures which it connects by means of enlarged portion or of intermediate bushings, the connecting device also including an inner tube extending inside the outer tube.

Such a device has the advantage of being simple, low in cost, reliable, robust, having good resistance to wear and to allow sealing of the cooling air circulation circuit during passage thereof into the connecting device.

This device is advantageously completed by the following features, taken along or in any one of their technically possible combinations:

- the inner tube has an opening extending over the entire length of said inner tube;
- the opening of the inner tube faces a solid portion of the outer tube;
- tabs of the inner tube extend toward the interior of said inner tube from areas on the perimeter of the opening of the inner tube;
- the connecting device can include means for retaining it against rotation to limit relative rotation between the inner tube and the outer tube;
- the inner tube includes an anti-rotation protrusion entering into the opening of the outer tube;
- the anti-rotation protrusion of the inner tube extends through the opening of the outer tube beyond said outer tube to extend outward;
- the outer tube comprises an anti-rotation protrusion extending outward from the outer surface of said outer tube;
- at least one of the outer tube and of the inner tube has a polygonal and/or non-circular cross-section;
- the device includes in addition a shutter blocking the end of the opening of the outer tube, said shutter being integral with the outer tube or the inner tube.

The invention also relates to a turbomachine comprising a connecting device according to the invention.

PRESENTATION OF THE FIGURES

Other features, aims and advantages of the invention will appear from the description hereafter, which is purely illustrative and not limiting, and which must be read with reference to the appended drawings, among which:

FIG. 1, already commented on, is a section view illustrating the arrangement of connecting devices in a low-pressure portion of a turbine of a turbomachine;

FIG. 2, already commented on, is an enlargement of FIG. 1 showing a connecting device arranged in a first enclosure at the high-pressure compressor and a second enclosure consisting of a vane of the turbine nozzle;

FIG. 3, already commented on, is a section view showing a connecting device arranged between a first enclosure consisting of a turbine nozzle vane and a second enclosure consisting of the inside of the low-pressure rotor;

FIGS. 4*a* and 4*b* are perspective views of the outer tube and the inner tube, respectively;

FIGS. 5*a* and 5*b* are section views, respectively of the outer tube and the inner tube;

Figure 11A:
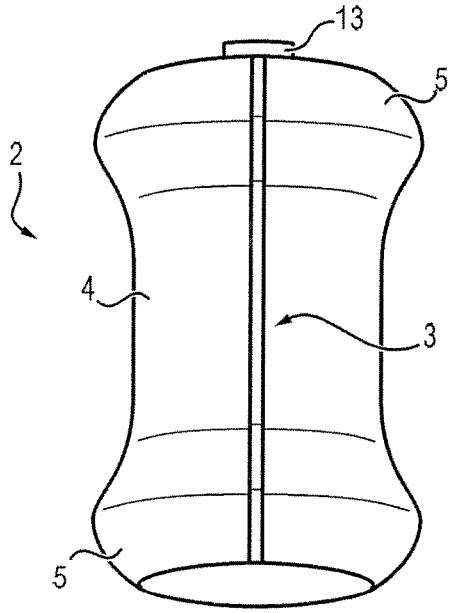
Figure 11B:
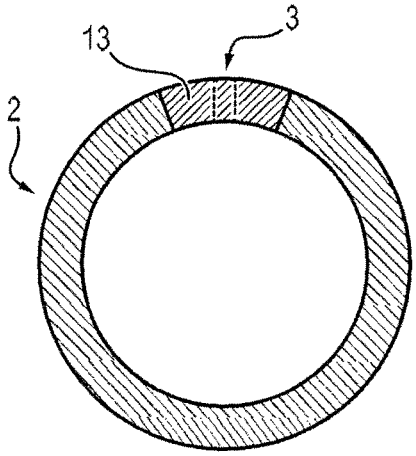
Figure 11C:
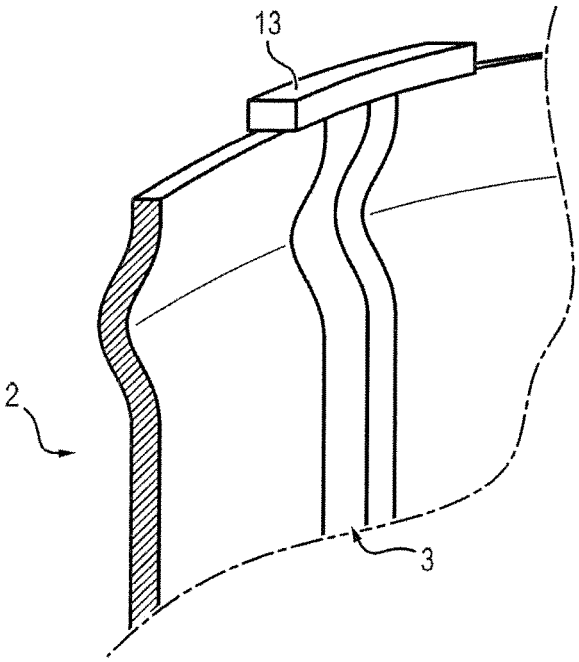
Figure 12:
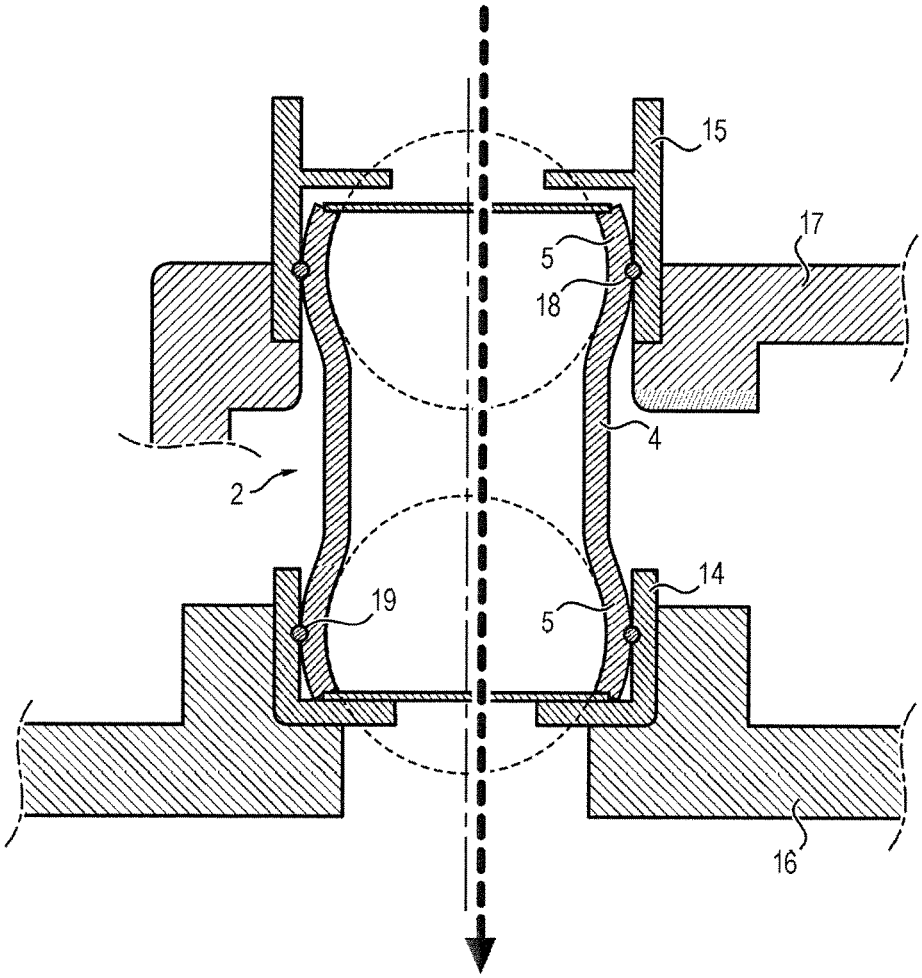
Figure 13:
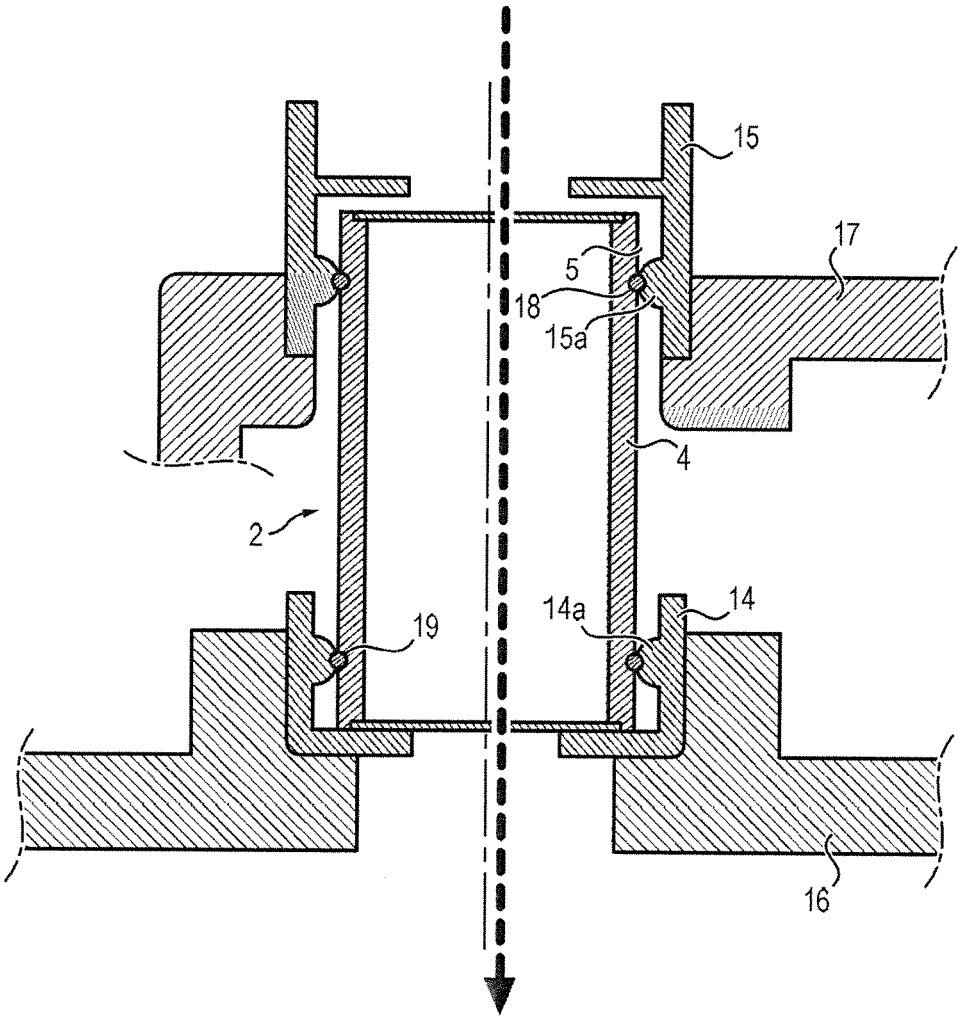

FIGS. 11*a*, 11*b* and 11*c* show a connecting device according to one possible embodiment of the invention, wherein a shutter is positioned at the end of the opening of the outer tube;

FIGS. 12 and 13 show different possible configurations for cooperation between the outer tube and the bushings for holding it.

DETAILED DESCRIPTION

Figure 6:
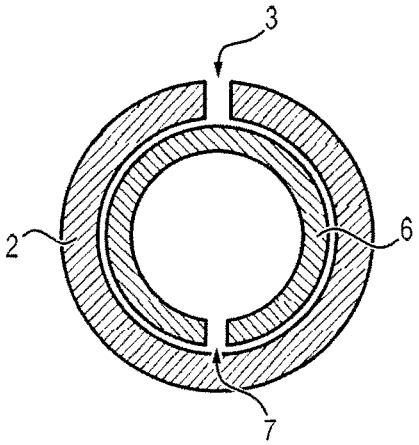
FIG. 6 is a section view of a connecting device according to one possible embodiment of the invention.

With reference to FIGS. 4*a* through 6 illustrating a possible embodiment of the invention, a connecting device according to the invention includes an outer tube 2 and an inner tube 6, said inner tube 6 extending within the outer tube 2 (FIG. 6).

The outer tube 4 has an opening 3 extending over the entire length of said outer tube 2. This opening 3 is preferably a slot in the wall of the outer tube 2, but it can take other more complex forms, toothed for example, or diagonal, or zig-zag or in any other acceptable form whose function approaches that of a slot. The opening 3 of the outer tube 2 can be accomplished by cutting by electrical melting using a wire.

The width of the opening 3 must be sufficient to allow a limited deformation of the outer tube 2 so as to decrease the forces applied to the structure of the outer tube 2 during its use (shear, thermal expansion . . . ). However, the opening must not be too large, so as not to alter the structure of the outer tube 2. The presence of the opening 3 also allows a reduction in the dimensioning requirements of the outer tube 2.

It should be noted that the opening 3 of the outer tube 2 is preferably not covered by a joint due to the high temperatures to which the connecting device can be subjected, which can reach 500° C. In fact, the materials selected to constitute the tubes are chosen for their resistance to such temperatures. It is also possible to provide for a suitable coating such a cobalt deposit on the surfaces of the tubes.

Moreover, the connecting device being most often mounted in a blind manner inside orifices in the walls of the enclosures which it connects, there exists a non-negligible risk of damaging the sealing during assembly operations, with no possibility of verification.

Figure 1:
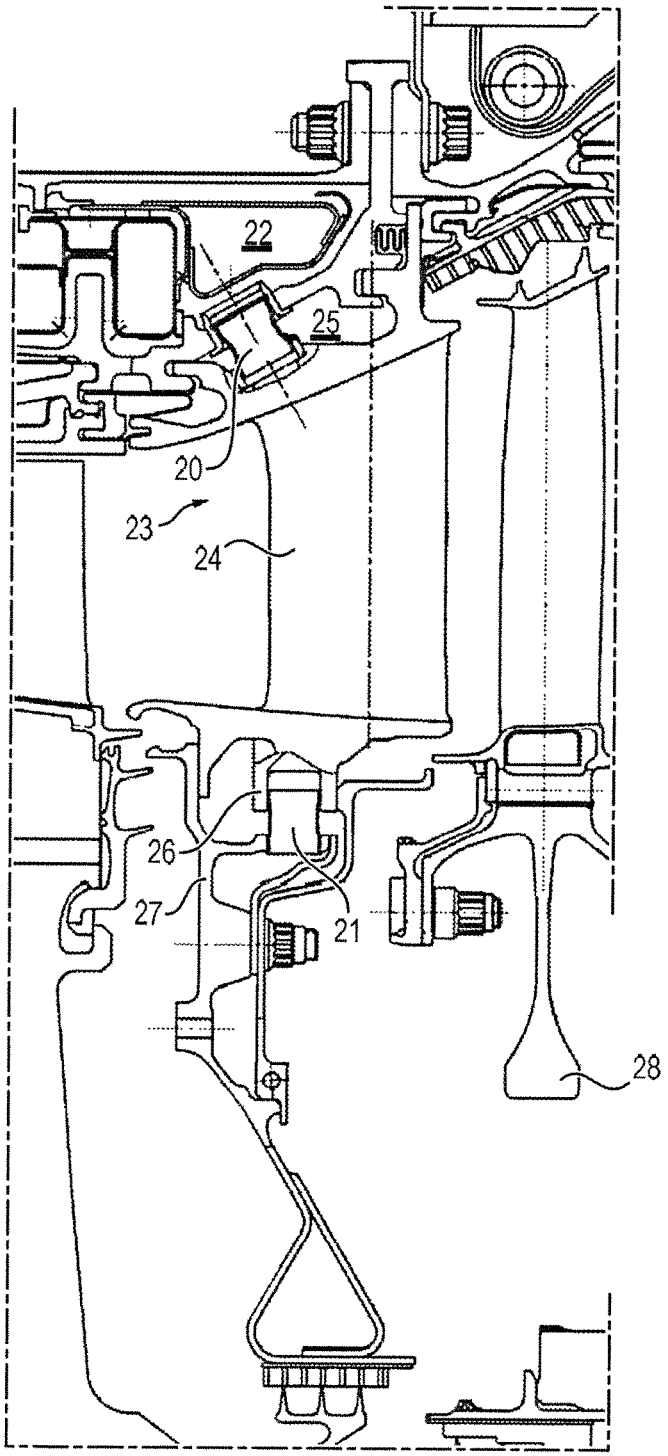
Figure 2:
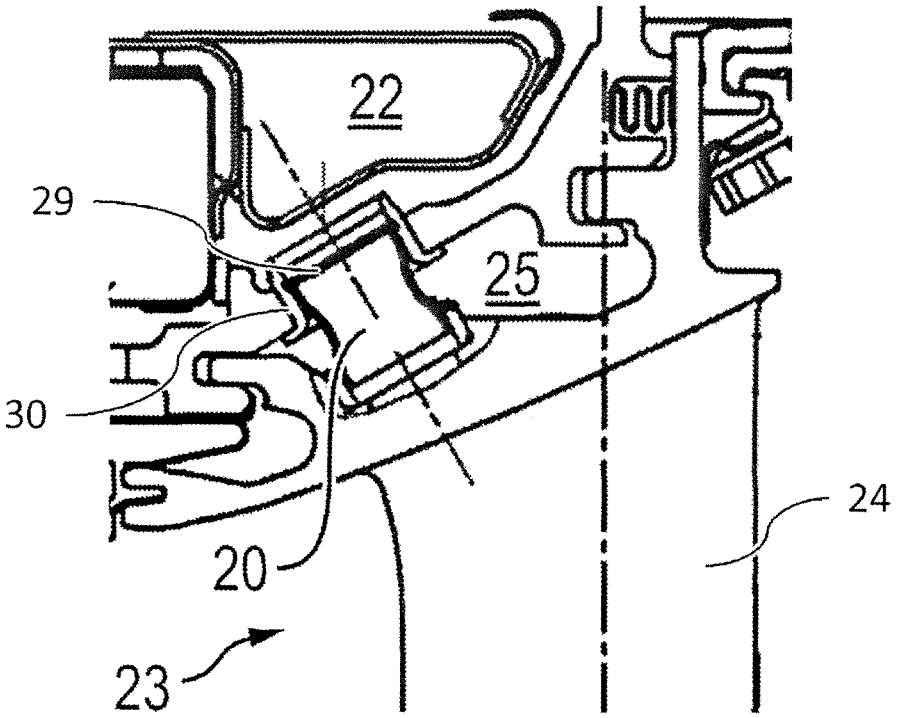
Figure 3:
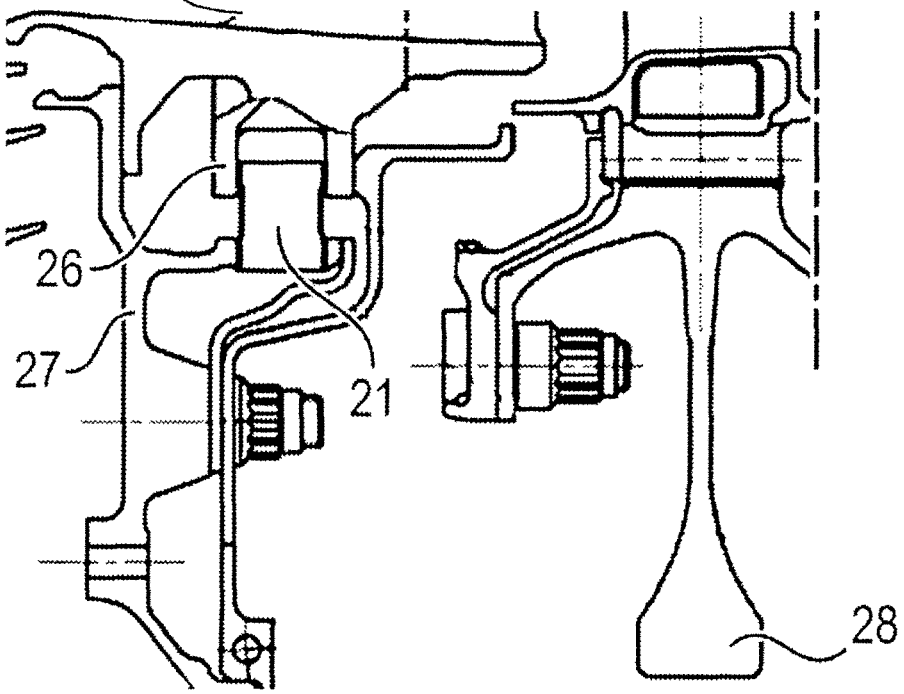
Figure 4A:
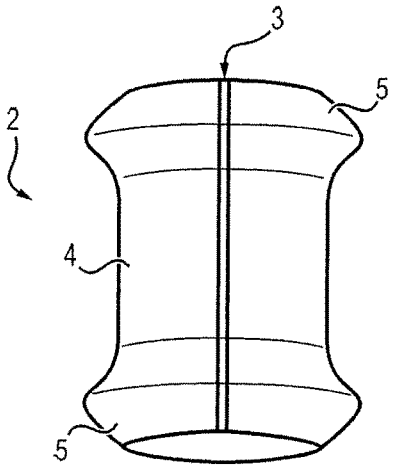
Figure 4B:
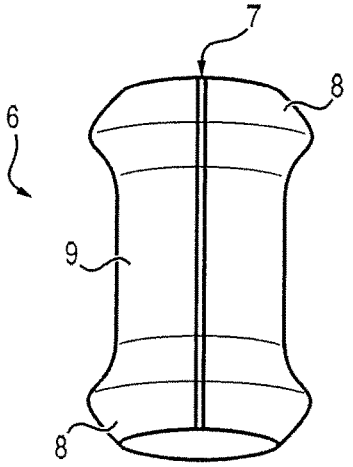
Figure 5A:
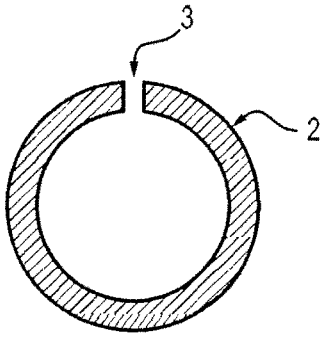
Figure 5B:
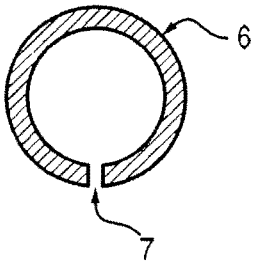

Preferably, the connecting device is mounted sliding within the orifices in the walls of the enclosures which it connects, and axial retaining means allow it to be held in position. Various axial retaining means can be contemplated to prevent a connecting device from leaving the orifice wherein it is positioned. With reference to FIG. 2, it is possible to cite in this respect the use of circlips 29, positioned in an annular groove of an intermediate bushing 30 housed in the orifice, or even stop means formed in protrusion over the cylindrical portion 4 of the outer tube 2.

To this end, in the embodiment shown, the outer tube 2 is shaped to cooperate with elements associated with said enclosures so as to keep the connecting device in position with respect to said enclosures. The outer tube presents a central cylindrical portion 4, enlarged portions 5 at its ends through which the outer tube 2 cooperates with the wall elements of the enclosures that it connects, or with intermediate bushings connecting it to said wall elements. In the example illustrated, the central cylindrical portion 4 has a constant circular section, while the circular section of its enlarged portions 5 at its ends varies like that of a portion of a sphere. The connections through which the connecting device is held in position with respect to the walls of the enclosures which it connects are thus linear annular connection.

The inner tube 6 is positioned inside the outer tube 2 and extends within said outer tube 2. The positioning of the inner tube 6 inside the outer tube 2 makes it possible to reinforce the connecting device. Moreover, the inner tube 6 makes it possible to ensure a sealing of the cooling air circuit which the connecting device makes it possible to establish between the two enclosures, this circuit being established through the internal tube 6. Thus, despite the opening along the outer tube 2 which allows relaxation of constraints, the losses of cooling air are limited.

The inner tube 6 is preferably formed to cooperate with the outer tube 2 so as to be held axially in position. In the example illustrated, the inner tube 6 has a cylindrical portion 9, enlarged portions 5 at its end through which the inner tube 6 cooperates with the outer tube 2. These enlarged portions 5 have here a spherical shape. Specific axial retaining members can also be provided for.

In addition, in the case of deterioration of the structural integrity of the outer tube 2, for example by chipping or breakage, the inner tube 6 will continue to ensure both a sealing for the air circuit, and reinforcement of the weakened outer tube 2. Consequently, resistance to wear of the connecting device is improved compared to a single tube.

The inner tube 6 can have an external cross-section of an extent that is smaller than the extent of the inner cross-section of the outer tube 2, so as to facilitate putting it in place. Preferably, the extent of the outer cross-section of the inner tube 6 is selected closest to the extent of the inner cross-section of the outer tube 2, so that the inner tube 6 is held by tight contact against said outer tube 2.

In one preferred embodiment, the inner tube 6 has an opening 7 extending over the entire length of said inner tube 6. Just as for the opening 3 of the outer tube, this is preferably a slot in the wall of the inner tube 6, but it can take other more complex forms, for example toothed, diagonal, zig-zag, or other acceptable forms the function whereof approaches that of a slot. The opening 7 of the inner tube 6 can also be accomplished by cutting by electrical melting with a wire.

The width of the opening 7 must be sufficient to allow limited deformation of the inner tube 6 so as to reduce the forces applied to the structure of the inner tube 6 during its use (shear, thermal expansion . . . ) or its positioning. However, the opening 7 must not be too large, so as not to alter the structure of the inner tube 6. The presence of the opening 7 also allows reducing the dimensioning requirements of the inner tube 6.

So as to retain the sealing in the air circulation circuit, the opening 7 of the inner tube 6 faces a solid portion of the outer tube 2. The opening 7 of the inner tube 6 is thus not facing the opening 3 of the outer tube 2. In this manner, the opening 7 of the inner tube 6 is blocked by the wall of the outer tube 2, ensuring a sealing for the air circuit. In FIG. 6, the respective openings of the inner tube 6 and of the outer tube 2 are shifted one with respect to the other by 180° about the common longitudinal axis of the inner and outer tubes. Other shifts can be provided, for example by 90°, but a shift of 180° makes it possible to provide a better sealing and makes it possible to improve the preservation of that sealing in the event of relative rotation between the inner tube 6 and the outer tube 2.

In order to prevent relative rotation between the inner and outer tubes, the connecting device can additionally also include means of retention against rotation for limiting a relative rotation between the inner tube 6 and the outer tube 2.

Figure 7:
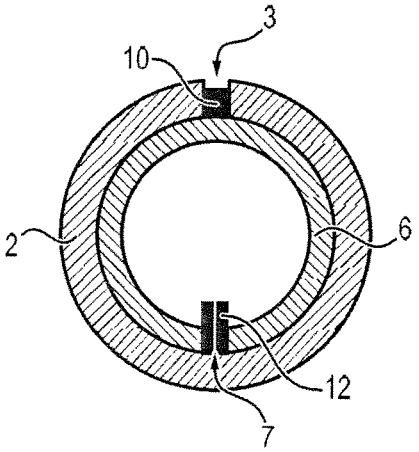
FIGS. 7 to 9 are section views of connecting devices provided with means for preventing rotation and with emplacement tabs according to possible embodiments of the invention.

In the embodiment of FIG. 7, the inner tube 6 includes an anti-rotation protrusion 10 engaged in the opening 3 of the outer tube 2. This anti-rotation protrusion 10 can take different forms, it can for example be elongated to extend along the opening 3 of outer tube 2, or take the shape of an anti-rotation pin. This anti-rotation protrusion 10 cooperates with the edges of the opening 3 of the outer tube 2 so as to prevent the rotation of the inner tube 6 with respect to the outer tube 2.

The anti-rotation protrusion 10 of the inner tube preferably has dimensions smaller than the opening 3 of the outer tube 2. For example, the length of the anti-rotation protrusion 10 is less than 80%, preferably 50% of the width of the opening 3 of the outer tube 2 at the place where said anti-rotation protrusion 10 is engaged in the opening 3 of the outer tube 2. The outer tube 2 thus retains the advantages obtained by its opening 3 as regards constraints. In addition, the fact of allowing a limited relative rotation between the inner tube 6 and the outer tube 2 also makes it possible to relax constraints, while still facilitating the placement of the inner tube 6 in the outer tube 2.

This anti-rotation protrusion 10 is preferably located on the inner tube 6 opposite the opening 7 of said inner tube 6, so as to retain a maximum shift between the respective openings of the inner and outer tubes, as illustrated in FIG. 7. Other configurations can, however, be considered.

Figure 8:
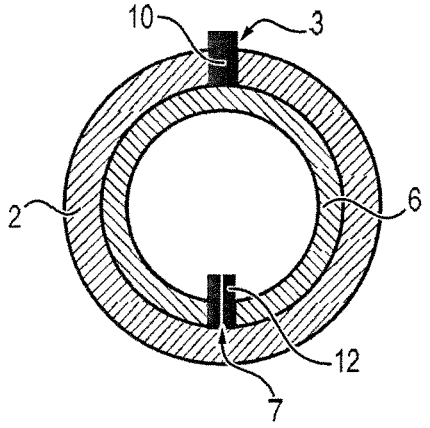

FIG. 8 illustrates a possible embodiment also using the retaining means of FIG. 7, wherein the anti-rotation protrusions 10 of the inner tube 6 extends through the opening 3 of the outer tube 2 beyond said outer tube 2. The anti-rotation protrusion 10 then extends outward from the connecting device and a recess can then be provided in the wall of the orifice wherein is placed said connecting device, for example in the holding bushing. The anti-rotation protrusion 10 then cooperates with the walls of this recess to provide for an anti-rotation function for the entire connecting device.

Figure 9:
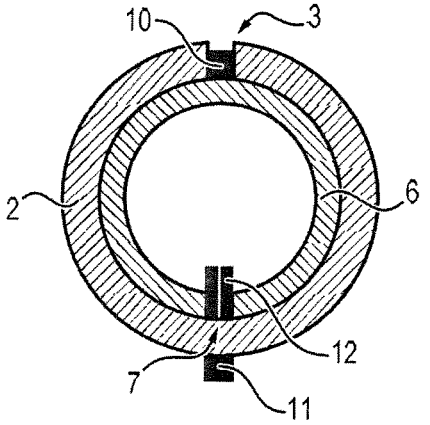

FIG. 9 illustrates a possible embodiment of the invention, similar to that of FIG. 7, wherein the outer tube 2 also has an anti-rotation protrusion 11 extending outward from the outer surface of said outer tube 2. Just as for the embodiment of FIG. 8, the anti-rotation protrusion 11 of the outer tube then extends outward from the connecting device and a recess can then be provided in the wall of the orifice wherein is placed the connecting device, for example in the holding bushing. The anti-rotation protrusion 11 then cooperates with the walls of said recess to provide an anti-rotation function to the entire connecting device.

In the embodiments illustrated by FIGS. 7 to 9, tabs 12 of the inner tube 6 extend outward from said inner tube 6 from areas on the perimeter of the opening 7 of the inner tube 6. The tabs form a support for a tool which will compress the opening 7 of the inner tube 6 by means of these tabs 12 so as to facilitate the placement or the removal of the inner tube 6 in the outer tube 2.

Figure 10:
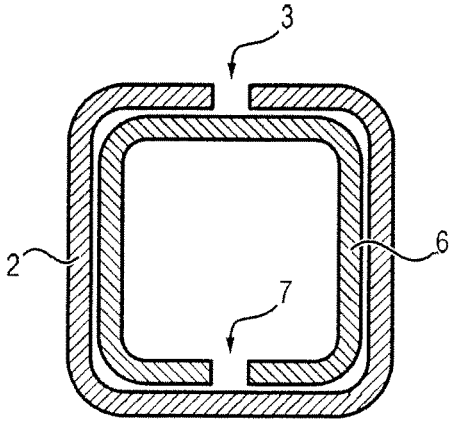
FIG. 10 is a section view of a connecting device according to a possible embodiment of the invention, wherein the outer tube and the inner tube have non-circular cross-sections.

In order to limit the relative rotation of the outer and inner tubes, it is also possible to provide that at least one of the outer tube 2 and the inner tube 6 has a polygonal and/or non-circular cross-section. FIG. 10 has a possible embodiment wherein the outer tube 2 and the inner tube 6 both have a cross-section with a square shape overall. The presence of corners makes it possible to limit the relative rotation between the outer 2 and inner 6 tubes, but is not necessarily required, since an oval section tube would also limit rotation.

It should be noted that an outer tube 2 with a polygonal and/or non-circular section can make it possible to limit rotation of the connecting device with respect to the recess wherein it is placed.

FIGS. 11*a*, 11*b* and 11*c* show a connecting device according to one possible embodiment of the invention, wherein a shutter 13 is positioned at one end of the opening 3 of the outer tube 2. The shutter 13 thus makes it possible to improve the sealing of the connecting device by blocking the end of the opening 3.

The shutter 13 can be an integral part of the outer tube 2, in which case it is integral on one side of the wall of the outer tube 2 and continues on the other side of the opening 3 of which it obstructs the opening at the end of the outer tube 2, to cover the wall on the other side of the opening 3.

The shutter 13 can also be part of the inner tube 6, particularly of the anti-rotation protrusion 10 of the inner tube 6. The shutter 13 then also constitutes an axial retaining means between the inner tube 6 and the outer tube 2.

FIG. 12 shows connections through which the outer tube 2 is held in position in the orifices of the walls of the enclosures which it connects by means of intermediate bushings 14, 15. As described above, the outer tube 2 has a central cylindrical portion 4, enlarged portions 5 at its ends through which the outer tube 2 cooperates with the intermediate bushings 14, 15 connecting it to wall elements 16, 17. In the example illustrated, the central cylindrical portion 4 has a constant circular cross-section, while the circular cross-section at its enlarged portions 5 at its ends varies like that of a portion of a sphere. The connections 18, 19 by which the connecting device is held in position with respect to the walls of the enclosures which it connects are thus linear annular connections.

The linear annular connections make it possible to ensure a linear sealing so as to prevent air leaks between the connecting bushings 14, 15 and the outer tube 2. However, this configuration of the outer tube 2, called "dog bone," is not the only configuration that makes it possible to obtain linear annular connections suitable for ensuring a linear sealing between the connecting device and the intermediate bushings 15, 16, and other configurations can be considered.

For example, FIG. 13 shows another configuration for the outer tube 2, wherein the outer tube 2 is straight, that is its diameter is constant. The intermediate bushings 14, 15 each have an excrescence 14*a*, 15*a* directed toward the inside of said bushings 14, 15, and the convex shape whereof makes it possible to defined with the outer tube 2 a linear annular connection between said outer tube 2 and said bushing 14, 15 to ensure a linear sealing of the connection. It is possible of course to adapt this configuration by keeping for example a spherical portion on the outer tube 2 and in providing only one bushing 14, 15 provided with one excrescence 14*a*, 15*a*.

The excrescence 14*a*, 15*a* is continuous over the inner circumference of the bushing 14, 15 to which it belongs, and preferably takes the form of a ring of which the cross-section is partially circular.

The invention also relates to a turbomachine provided with a connecting device including the characteristics previously described.

The invention claimed is:

1. A turbomachine including a connecting device arranged between two enclosures of the turbomachine to connect said two enclosures and to allow the establishment through said connecting device of circulation of a cooling fluid between said enclosures, wherein a first enclosure of said two enclosures is in a compressor of the turbomachine and a second enclosure of said two enclosures is in a turbine nozzle vane of the turbomachine, or a first enclosure of said two enclosures is in a turbine nozzle vane of the turbomachine and a second enclosure of said two enclosures is an inside of a rotor of the turbomachine, said connecting device including an outer tube having a wall and extending along a longitudinal axis, said wall of the outer tube having an opening in the wall of the outer tube extending over the entire length of the wall of said outer tube along said longitudinal axis, said outer tube cooperating with wall elements of both enclosures which said connecting device connects through enlarged portions of the wall of said outer tube whereby the outer tube contacts wall elements of the two enclosures or through intermediate bushings contacting wall elements of the two enclosures, said intermediate bushings disposed between the outer tube and wall elements of the two enclosures, wherein the connecting device further includes an inner tube extending inside the outer tube along the longitudinal axis, said inner tube having a wall.

2. The turbomachine of claim 1, wherein the wall of the inner tube has an opening in the wall of the inner tube extending over the entire length of said inner tube along the longitudinal axis.

3. The turbomachine of claim 2, wherein the opening in the wall of the inner tube faces a solid portion of the wall of the outer tube.

4. The turbomachine of claim 2, wherein tabs of the inner tube extend toward the interior of said inner tube from areas at the perimeter of the opening in the wall of the inner tube.

5. The turbomachine of claim 1, wherein the connecting device includes an anti-rotation protrusion to limit relative rotation between the inner tube and the outer tube.

6. The turbomachine of claim 1, wherein the inner tube includes an anti-rotation protrusion engaged in the opening in the wall of the outer tube.

7. The turbomachine of claim 1, wherein the outer tube includes an anti-rotation protrusion extending outward from the outer surface of the wall of said outer tube.

8. The turbomachine of claim 1, wherein at least one of said outer tube and said inner tube has a polygonal and/or non-circular cross-section.

9. The turbomachine of claim 1, wherein the connecting device further includes a shutter obstructing the end of the opening in the wall of the outer tube, said shutter being integral with the wall of the outer tube or with the wall of the inner tube.

* * * * *